US005372203A

United States Patent [19]

Galaszewski

[11] Patent Number: 5,372,203

[45] Date of Patent: Dec. 13, 1994

[54] CONCEALED SPRINKLER HEAD

[75] Inventor: William Galaszewski, Brookfield, Wis.

[73] Assignee: Star Sprinkler Corporation, Milwaukee, Wis.

[21] Appl. No.: 56,425

[22] Filed: Apr. 30, 1993

[51] Int. Cl.[5] ..... A62C 37/11; A62C 37/14

[52] U.S. Cl. ..... 169/37; 169/38

[58] Field of Search ..... 169/37, 38, 39, 40, 169/41, 42, 90

[56] References Cited

U.S. PATENT DOCUMENTS

| | | | |
|---|---|---|---|
| 2,389,331 | 11/1945 | Tyden | 169/37 |
| 3,389,884 | 6/1968 | Ault | 248/345 |
| 3,998,273 | 12/1976 | Juliano | 169/37 |
| 4,014,388 | 3/1977 | Anderson | 169/37 |
| 4,015,665 | 4/1977 | Simons et al. | 169/40 |
| 4,066,129 | 1/1978 | Anderson | 169/37 |
| 4,105,076 | 8/1978 | Simons et al. | 169/40 |
| 4,376,465 | 3/1983 | Simons et al. | 169/39 |
| 4,491,182 | 1/1985 | Pieczykolan | 169/38 |
| 4,508,175 | 4/1985 | Pieczykolan | 169/38 |
| 4,618,002 | 10/1986 | Mears | 169/37 |
| 4,662,455 | 5/1987 | Simons | 169/37 |
| 4,757,865 | 7/1988 | Simons | 169/39 |
| 4,766,961 | 8/1988 | Macie | 169/38 |
| 4,926,946 | 5/1990 | Polan | 163/37 |
| 5,072,792 | 12/1991 | Simons et al. | 169/37 |

*Primary Examiner*—David M. Mitchell
*Assistant Examiner*—Andrew C. Pike
*Attorney, Agent, or Firm*—Andrus, Sceales, Starke & Sawall

[57] ABSTRACT

An improved concealed sprinkler head including a frame having a outlet that is connected to a water line and a valve cap encloses the outlet and is held in the closed position by a thermally responsive mechanism, such as a glass bulb. A preassembled cover plate unit is mounted to the frame after the frame is installed with the water line. The cover plate unit includes an outer tubular sleeve that surrounds the frame and a spring is located within the sleeve and is maintained in a compressed condition by a ring having tabs which engage a recess in the sleeve. The lower edge of the sleeve carries a cover plate which is connected to the sleeve via a fusible metal, such as solder. The ring is provided with a pair of opposed guide channels which receive the side edges of the arms of the frame as the cover plate unit is slid upwardly over the frame. The ring is also provided with a pair of downwardly extending legs carrying spring clips which engage notches in the lower ends of the arms to maintain the cover unit in position on the frame.

16 Claims, 3 Drawing Sheets

FIG. 3
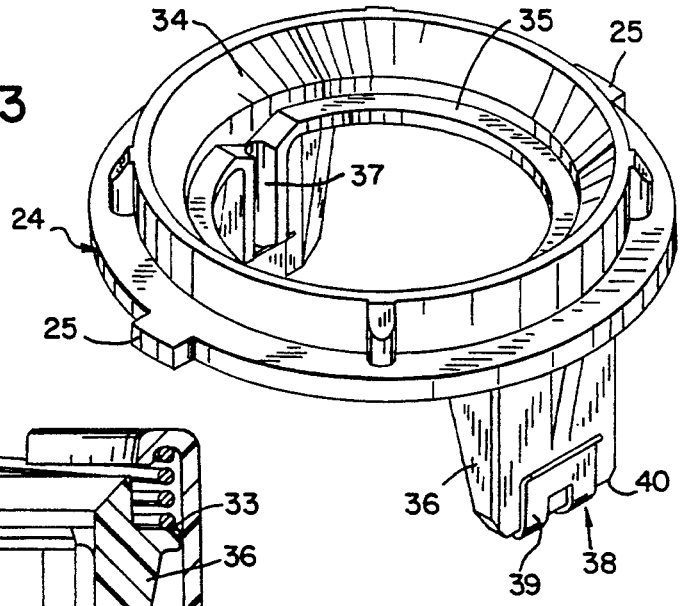
FIG. 4
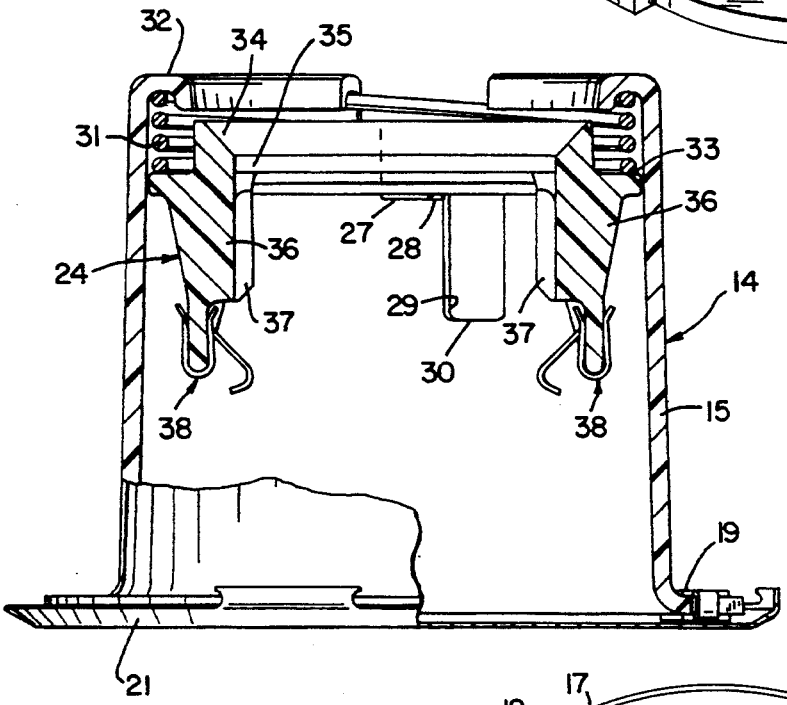
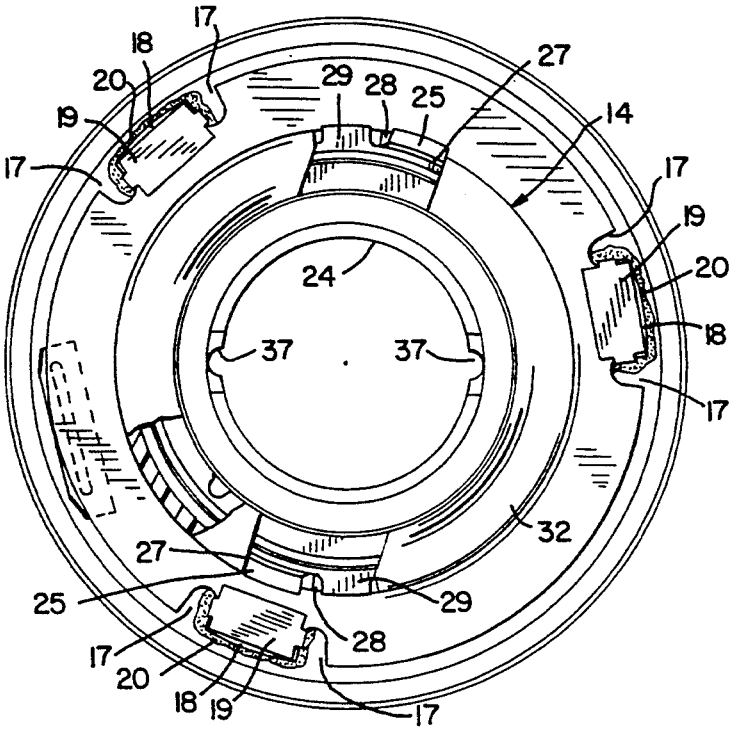
FIG. 5

FIG. 6
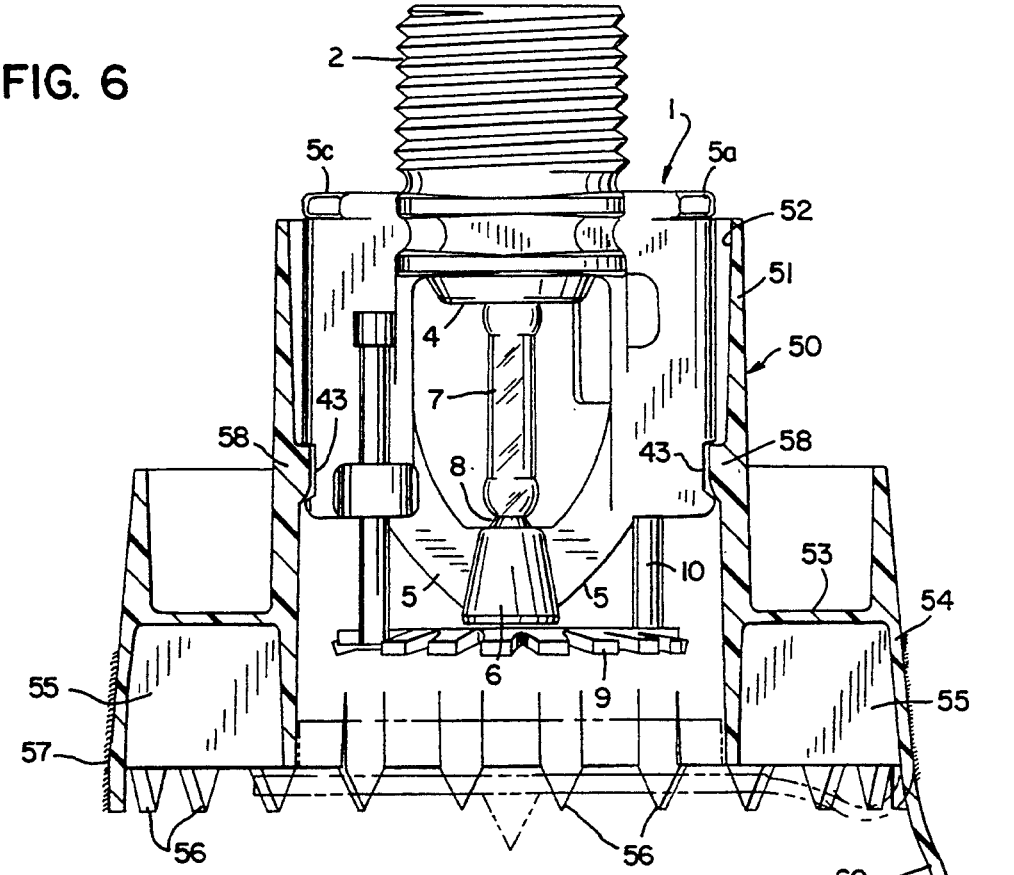
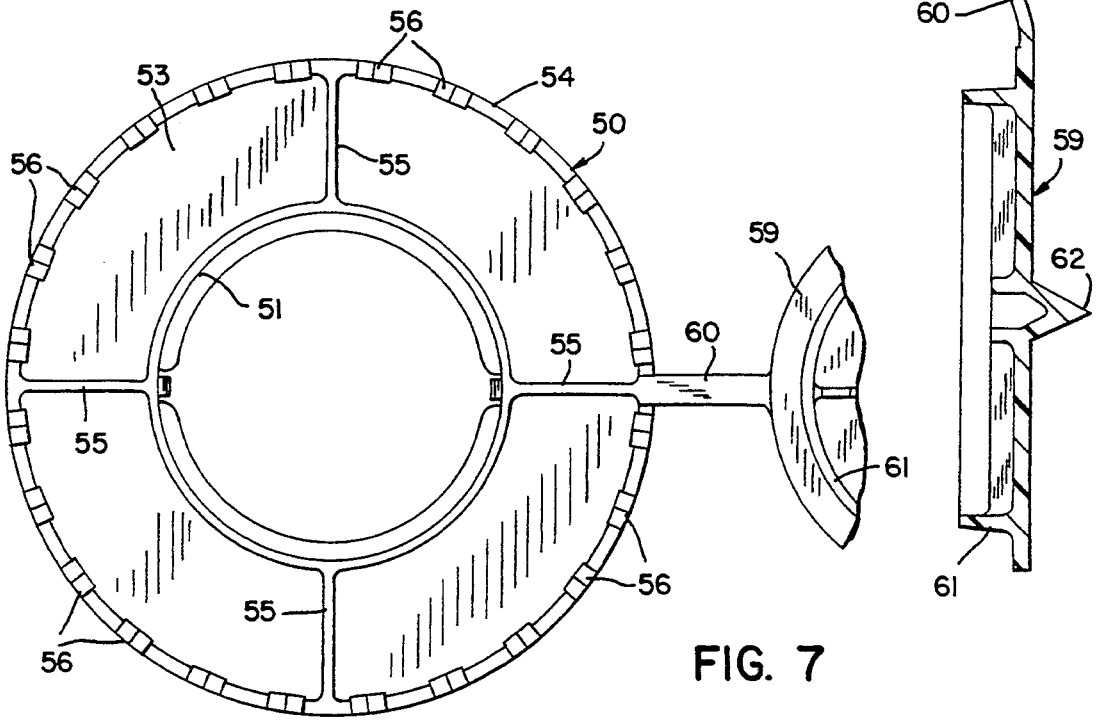
FIG. 7

CONCEALED SPRINKLER HEAD

BACKGROUND OF THE INVENTION

The conventional pendant-type automatic sprinkler head includes a body or frame that has an outlet which is normally enclosed by a valve cap, and the cap is held in the closed position by a releasable lever assembly which includes a thermally responsive element, such as a low-melting-point fusible link or a glass bulb. With a pendant-type sprinkler head, the lever assembly extends downwardly beneath the ceiling of the building, and when the temperature increases to a predetermined level, the thermally responsive element will melt, enabling the water pressure in the line to release the valve cap and discharge the water.

In residential dwellings and commercial buildings, it is often desired to utilize a sprinkler head that is located above the ceiling, so that the operative parts are not exposed to view. With this type of construction, the sprinkler head is concealed within the ceiling by a decorative plate that is mounted flush against the undersurface of the ceiling, so that the operative parts are not visible. U.S. Pat. Nos. 3,633,676, 3,714,898 and 4,015,665 describe concealed sprinkler heads.

A typical concealed sprinkler head includes a cylindrical sleeve or cup, which is positioned around the cast metal frame or body, and a decorative cover plate is attached to the sleeve and encloses the sprinkler head as well as the opening in the ceiling. In normal practice, the sleeve is preassembled in the factory with the frame. At the location of use, the sprinkler head, along with the attached sleeve, is installed with the water pipe line and after installation, the sprinkler head is tested for possible leakage. Because of the presence of the cylindrical sleeve, small leakage at the threaded joint may not be readily visible, with the result that the time required for the pressure testing procedure is substantially increased.

In order to properly position the cover plate of the concealed sprinkler head with respect to a suspended ceiling, the body or frame of the sprinkler head must be installed a precise distance from the lower surface of the ceiling. Concealed sprinkler heads, as used in the past, have had minimum provisions for adjustment, with the result that if the critical distance between the body and the ceiling is not maintained, the cover plate would not be positioned flush with the ceiling, thereby resulting in an unsightly gap.

U.S. Pat. No. 5,072,792 discloses a concealed sprinkler head having a preassembled cover plate unit which is attached to the frame of the sprinkler head after the frame is connected to the water line. The frame includes a pair of arms which extend downwardly from the base of the frame and are joined together at a junction. A valve cap normally encloses the outlet in the frame and a releasable thermally responsive mechanism interconnects the junction and the valve cap. When the thermally responsive mechanism is exposed to a predetermined elevated temperature, the mechanism will release and open the valve cap.

In accordance with the description of the above mentioned patent, after the sprinkler head has been installed with the water line and tested for possible leakage, the preassembled cover plate assembly is installed with the sprinkler head. The cover plate assembly includes a cup-shaped outer shell and a mounting ring or disc is located within the shell. Interposed between the upper end of the shell and the ring is a compression spring. In the pre-assembled unit, the ring is held in position within the shell by the engagement of peripheral projections on the ring with notches in the upper portion of the shell. The lower peripheral edge of the shell is connected via a fusible metal, such as solder, to a cover plate.

To assemble the cover plate unit of the aforementioned patent, the sprinkler head of the unit is slipped upwardly over the frame. with the arms of the frame being received within a central opening in the disc. As the unit is moved upwardly on the frame, flexible tabs on the ring engage a groove in the frame. The sleeve and cover plate are then rotated relative to the ring which brings the projections on the ring into registry with elongated slots in the shell. With the projections in registry with the slots, the force of the spring will then bias the shell and cover plate upwardly relative to the ring thus urging the cover plate into engagement with the undersurface of the ceiling.

SUMMARY OF THE INVENTION

The invention is directed to an improved concealed sprinkler head having a preassembled cover plate unit which can be more readily installed with the frame of the sprinkler head after the sprinkler head is connected to the water line.

In accordance with the invention, the preassembled cover plate unit includes a generally tubular shell or sleeve. A ring is mounted within the outer sleeve and is provided with a pair of tabs which are engaged with the bottom edges of notches formed in the sleeve. A compression spring is interposed between an upper flange on the sleeve and the ring to urge the tabs into engagement with the notch bottoms.

The lower end of the sleeve carries a decorative cover plate which is connected to the sleeve via a fusible metal, such as solder.

To install the preassembled cover plate unit to the frame, the sleeve is slipped upwardly over the frame with the side edges of the arms of the frame riding within guide channels formed in the ring. When the sleeve has been moved upwardly to a predetermined position, spring clips mounted on the ring snap into engagement with notches in the lower ends of the arms of the frame to thereby lock the ring to the frame. With the ring connected to the frame, the outer sleeve and attached cover plate are rotated relative to the ring and frame, causing the tabs on the ring to fall into elongated slots which are located adjacent the notches in the sleeve. With the tabs in registry with the slots, the force of the compression spring will then urge the sleeve and attached cover plate upwardly relative to the ring, which is attached to the frame, thus urging the cover plate into engagement with the undersurface of the ceiling.

The mechanism of the invention facilitates the installation of the preassembled cover plate unit with the sprinkler frame after the frame has been installed with the water line. The engagement of the side edges of the frame with the guide channels in the ring aid in guiding the preassembled unit upwardly on the frame and the spring clips provide a positive lock of the unit to the frame.

Through use of the preassembled cover plate unit, the sprinkler head can be attached to the water line and tested for possible leakage before the cover plate unit is installed with the sprinkler head. Thus, the testing can be carried out without the sleeve in position so that small leakage through the threaded joint is readily visible.

Over a period of time, the vertical distance between the water line and the lower surface of a ceiling of a building may vary slightly. As the cover plate is biased upwardly by the compression spring, an automatic floating action is affected which enables the cover plate to float up to one-half inch to accommodate this variation in vertical distance.

It is contemplated that the tubular sleeve can be formed of a non-metallic material, such as plastic, so that a faster response for release of the cover plate is achieved due to the fact that the plastic sleeve will not serve as a metal heat sink, as in conventional concealed sprinkler heads.

Other objects and advantages will appear in the course of the following description.

DESCRIPTIONS OF THE DRAWINGS

The drawings illustrate the best mode presently contemplated of carrying out the invention.

In the drawings:

FIG. 3 is a perspective view of the ring;

FIG. 4 is a side elevation with parts broken away of the preassembled cover plate unit;

FIG. 5 is a top plan view of the unit shown in FIG. 4;

FIG. 6 is a longitudinal section of a protective housing attached to the sprinkler head; and FIG. 7 is a top plan view of the housing of FIG. 6.

DESCRIPTION OF THE ILLUSTRATED EMBODIMENT

Figure 1:
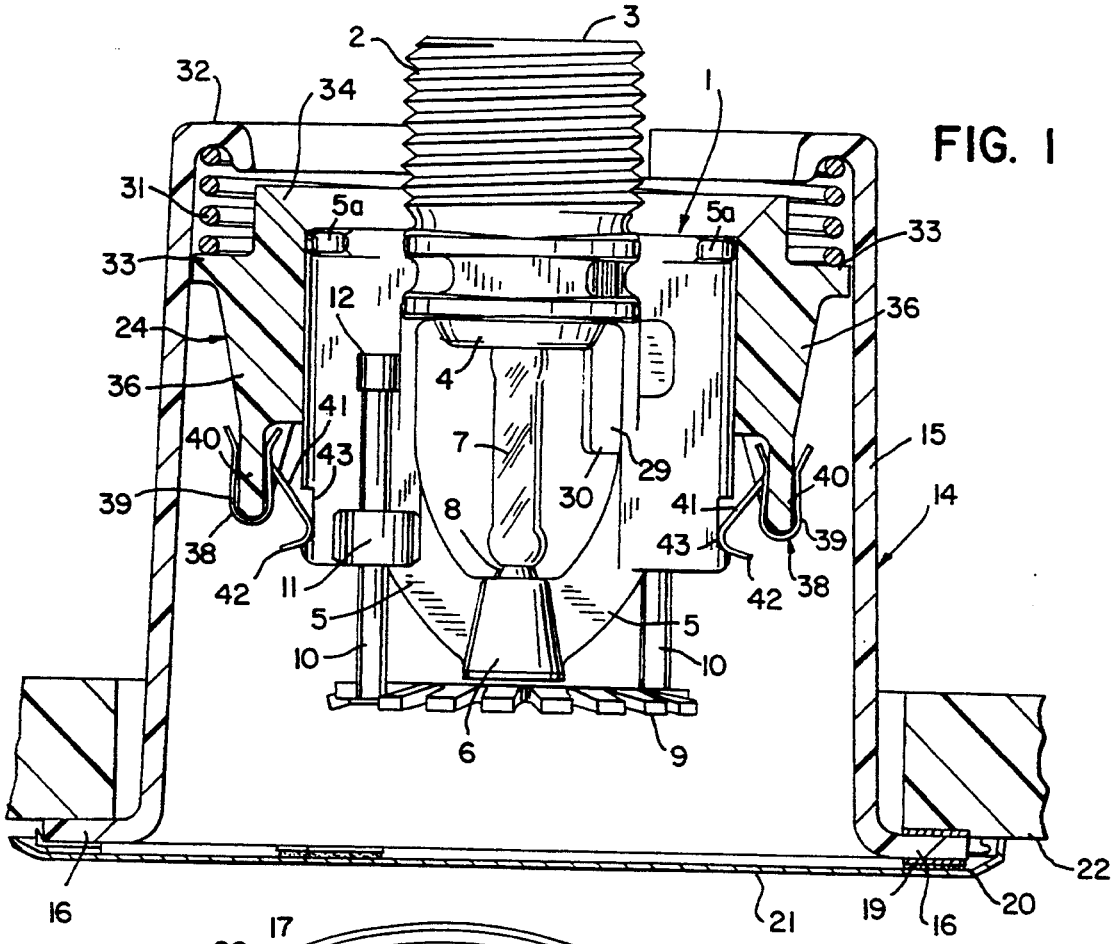
FIG. 1 is a longitudinal section of the sprinkler head of the invention as installed in a building.

FIGS. 1–5 illustraté a concealed, automatic sprinkler head including a cast metal frame 1 having an upper end 2 that is threaded to a water line. The upper end 2 of frame 1 defines an outlet 3 which is normally enclosed by a valve cap 4. Frame 1 also includes a pair of arms 5 and the lower ends of the arms are connected together at a junction 6.

Valve cap 4 is held in the closed position by a releasable, thermally responsive element which, as shown in the drawings, can constitute a frangible glass bulb 7. When the bulb is subjected to a predetermined elevated temperature, the bulb will fracture enabling the water pressure in line 2 to release the valve cap 4. The upper end of bulb 7 is engaged with the lower surface of valve cap 4, while the lower end of the bulb is engaged with the tip of adjusting screw 8 which is threaded within an opening in junction 6. Through threaded adjustment of screw 8, the compressive stress on bulb 7 can be varied, as desired.

Figure 2:
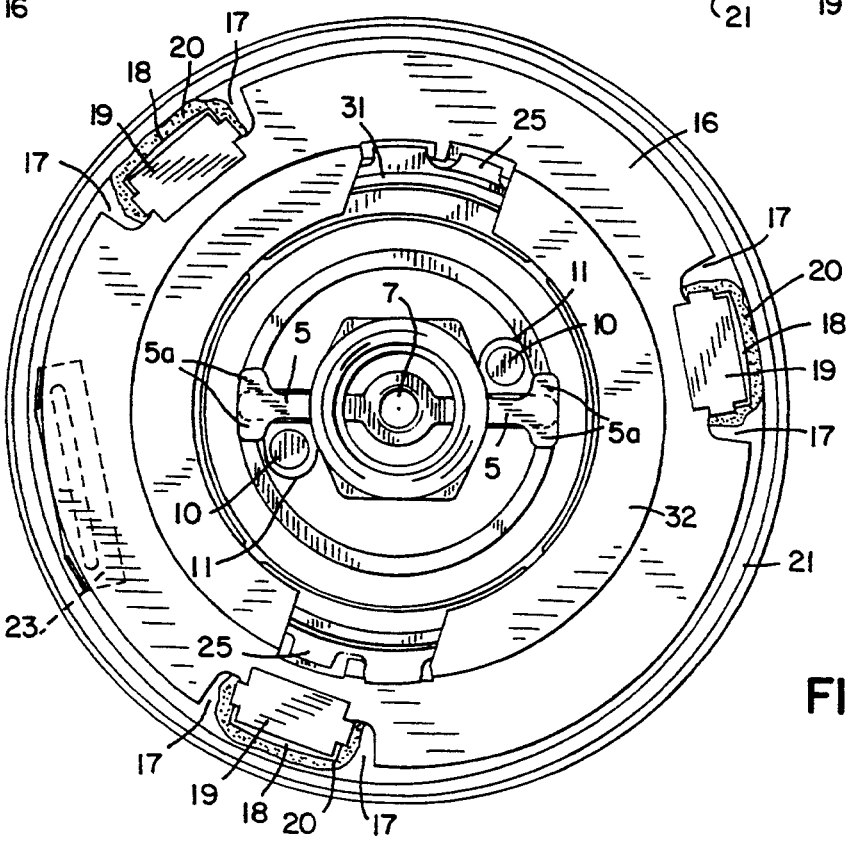
FIG. 2 is a top view of the sprinkler head.

When valve cap 4 is released through fracture of the bulb 7, the water is deflected outwardly in the desired spray pattern by a deflector 9. Deflector 9 is carried by a pair of rods 10 which are mounted for sliding movement in openings in bosses 11 which project outwardly from arms 5. As best shown in FIG. 2, bosses 11 are located on opposite sides of the respective arms 5. When valve cap 4 opens, the water pressure will force the deflector 9 downwardly until the enlarged heads 12 on rods 10 engage bosses 11 and this engagement will maintain the deflector in the desired lowered position so that the water will be deflected outwardly in the desired spray pattern.

A preassembled cover plate unit 14 is installed with the frame 1 after the frame has been connected to water line 2. The cover plate unit 14 includes a generally cup-shaped outer sleeve or shell 15 and the lower end of the sleeve is provided with an outwardly extending flange 16. Radial slits 17 divide the flange 16 into a plurality of feet or tabs 18 and a generally U-shaped metal clip 19 is mounted on each foot 18. Clips 19 are connected through a low-melting-point alloy 20, such as solder, to a solid decorative cover plate 21. With the cover plate 21 mounted against the ceiling 22, the frame and other components of the sprinkler head are concealed to provide an attractive appearance for the unit. As seen in FIG. 2, a leaf spring 23 is located between the flange 16 of shell 15 and cover plate 21, and the force of the spring 23 acts to urge the cover plate downwardly away from the shell when the low melting point alloy 19 melts.

The cover plate unit 14 also includes a ring 24 that is mounted within the upper end of sleeve 15 and the configuration of ring 24 is best illustrated in FIG. 3. In the preassembled unit 14, peripheral tabs 25 on ring 24 are engaged with the bottom edges of shallow recesses or notches 27 formed in sleeve 15. A shallow projection or dimple 28 borders the bottom edge of each notch 27 and prevents the tab 25 from sliding from the notch 27.

In addition, sleeve 15 is formed with longitudinally elongated recesses or slots 29, each of which borders a notch 27 and is offset from the notch 27. Each slot 29 is bordered by a bottom edge 30.

As illustrated in FIG. 1, a compression spring 31 is interposed between the upper inwardly extending flange 32 on sleeve 15 and an outer annular ledge 33 on ring 24. With tabs 25 engaged with the bottom edges of notches 27, the spring 31 will be retained in a compressed state in the preassembled unit 14.

As best shown in FIG. 3, ring 24 is also formed with an inner sloping or incline surface 34 and an inner annular ledge 35. The incline surface 34 aids in centering the preassembled unit 14 on the frame 1, as the unit 14 is slipped upwardly over the frame during installation, while the inner ledge 35 engages stops **5*a* on the upper ends of arms 5, to properly position the preassembled unit 14 relative to frame 1**.

Ring 24 also includes a pair of diametrically opposed, downwardly extending legs 36 which are located approximately 90° from tabs 25, as shown in FIG. 3. The inner surface of each leg 36 defines a guide channel 37 which receives the side edge of the respective arm 5 as the unit 14 is slipped upwardly over frame 1.

A spring clip 38 is mounted on the lower end of each leg 36. Each spring clip 38 has a generally U-shaped body section 39 which extends around the lower end 40 of leg 36, and a flexible arm 41 extends inwardly from each body section 40 and terminates in a bent end 42.

Bent ends 42 are adapted to snap into engagement with notches 43 formed in the lower ends of arms 5 as the preassembled cover plate unit 14 is slipped upwardly over frame 1. The lower edge of each notch 43 defines an abutment which is engaged by end 42 to thereby lock the ring 24 relative to frame 1.

Frame 1, without the preassembled cover plate unit 14, is initially threaded onto water line and the system is then tested for possible leakage. As the sleeve 15 is not attached at this time, any leakage through the threaded joint is readily visible.

The preassembled unit 14 is then attached to the frame 1 by sliding the unit upwardly over the frame with the guide channels 37 sliding along the side edges of arms 5 until the bent ends 42 of spring clips 38 engage the notches 43, thus locking the preassembled unit relative to frame 1. At this time, the tabs 25 on ring 24 are engaged with the lower edges of notches 27 so that the spring is in a compressed condition. After engagement of the spring clips 38 with the notches 43, sleeve 15, along with the attached cover plate 21, is rotated relative to ring 24 to bring the tabs 25 into registry with the elongated slots 29. Spring 31 will then expand, urging the cover plate 21 upwardly until the peripheral edge of the cover plate engages the lower surface of ceiling 23.

In use, if the sprinkler head is subjected to an elevated temperature, the solder 20 will melt releasing the cover plate 21 so that the bulb 7 will then be exposed to the heated air and gasses of combustion. When a predetermined elevated temperature is reached, the bulb 7 will fracture, releasing the valve cap 4 so that the water in line 2 will open the valve cap and force the deflector 9 downwardly to its lower or extended position. The water being discharged through the outlet 3 will then strike the deflector plate and be deflected outwardly in the desired spray pattern.

The sprinkler head of the invention can be more rapidly installed as compared to conventional concealed sprinkler heads. The preassembled cover unit 14 is merely slipped upwardly over the frame 1, after the frame is installed with the water line 2, to engage the spring clips 38 with the notches 43. As the notches are located at the lower ends of arms 5, the operator can readily determine when the engagement is achieved so that a positive lock is obtained. After engagement of the spring clips with the notches 43, the sleeve and cover plate are then rotated through a small arc to release the spring 31 and enable the spring to urge the cover plate 21 into engagement with the ceiling. No special tools are required for attaching the preassembled unit 14 to the sprinkler head.

FIGS. 6 and 7 illustrate a feature of the invention in which a temporary flexible protective housing 50 is installed with the sprinkler head. As shown in FIG. 6, the housing 50, which is preferably formed of a flexible plastic material such as polyethylene, includes an annular inner section 51 that defines a central opening 52. A flat surface 53 extends radially outward from inner section 51 and terminates in an annular skirt 54. Radial ribs 55 connect the inner annular section 51 with the upper portion of skirt 54, while the lower edge of the skirt is provided with a plurality of generally V-shaped teeth 56. A portion of the outer surface of skirt 54 located above the lower edge is textured, as indicated by 57. Alternately, the lower portion of the skirt corresponding to textured portion 57 can be enlarged in diameter.

To connect the housing 50 to frame 1, tabs 58 extend inwardly from the section 51 which are engaged with the notches 43 in arms 5, as the housing is drawn upwardly over the frame.

In addition, a cap 59 is connected to skirt 54 via a flexible tether 60, and cap 59 is formed with an annular flange 61 which can be press fitted into the lower end of the skirt. Spike 62 projects outwardly of cap 59, as shown in FIG. 6.

Housing 50 provides a temporary protector for the sprinkler head, protecting the bulb 7 and other components during shipment and handling as well as during the period when the sprinkler head is attached to the water line but before the preassembled unit 14 is installed with the frame.

The engagement of the tabs 58 with notches 43 positions the lower edge of the skirt 54, as well as the upper margin of the textured surface 57 at a predetermined distance beneath the outlet 3 and thus serves as a gauge for installation of the ceiling 22. Further, when plastered ceilings are utilized, the skirt 54 serves as a shield or form to provide a hole in the plastered ceiling which is in proper alignment with the axis of the frame 1.

In other instances, a hole formed in a wallboard ceiling may be oversized and larger than the cover plate 21 which is to be subsequently installed. In this case, the skirt 54 of the temporary housing 50 serves as a form or mold and the ceiling can be plastered up to the skirt to fill in the enlarged area of the hole.

With the cap 59 inserted in the lower end of section 51, as illustrated by the dashed lines in FIG. 6, the spike 62 projects downwardly and is concentric with the teeth 56. When installing ceiling tile, the tile can be pushed upwardly against teeth 56 and spike 62, causing an imprint or depression on the upper surface of the tile. The central imprint made by spike 62 will serve as a guide for properly centering a cutting tool and the circular imprint made by teeth 56 will be an indication of the proper diameter for the hole to be cut in the tile to receive the sprinkler head.

Cap 59, when enclosing skirt 54, protects the sprinkler head from plaster or paint overspray. In certain installations, it may be desired to have the sprinkler heads operable before the ceiling is completed. In this situation, the cap 59 and tether 60 can be torn away, so that the bottom of the sprinkler head is exposed, yet the skirt 54 will protect the sprinkler head from damage by ladders, or building materials.

Due to the flexible nature of the plastic material, the temporary protective housing 50 can be readily removed from the frame by merely pulling downwardly on the housing. It is contemplated that the skirt may include suitable ridges or surface deviations which enable a workman to more easily grip the skirt to facilitate removal from the frame.

Various modes of carrying out the invention are contemplated as being within the scope of the following claims particularly pointing out and distinctly claiming the subject matter which is regarded as the invention.

I claim:

1. An improved concealed sprinkler head comprising a frame having an outlet to be connected to a water line, said frame including a pair of arms connected together at lower ends thereof at a junction, valve cap means to enclose said outlet, thermally responsive means interconnecting the valve cap means and said junction for releasing said valve cap means when said thermally responsive means is exposed to a predetermined elevated temperature, and a preassembled cover plate unit connected to the frame and including a generally tubular sleeve disposed outwardly of said frame, a ring disposed within the sleeve and located outwardly of the frame, biasing means interposed between the sleeve and the ring, spring clip means for locking the ring to the lower ends of the arms of the frame, a cover plate disposed beneath said frame and concealing said frame, fusible means interconnecting a lower end of the sleeve and the cover plate, and interconnecting means interconnecting the sleeve and said ring for maintaining the biasing means in a compressed condition as said unit is assembled with said frame, rotation of said sleeve and cover plate relative to said ring releasing said interconnecting means to thereby release the biasing means from the compressed condition to urge the sleeve and cover plate upwardly relative to said ring to bring said cover plate into engagement with lower surface of a ceiling of a building.

2. The sprinkler head of claim 1, wherein said spring clip means comprises a pair of spring clips connected to opposed portions of said ring, each arm having an abutment disposed to be engaged by one of said clips.

3. The sprinkler head of claim 2, and including stop means disposed on an upper end of said frame for limiting the upward movement of said cover plate unit relative to said frame.

4. The sprinkler head of claim 3, wherein said stop means comprises a stop disposed on an upper end of one of said arms and disposed to engage a surface on said ring as said unit is moved upwardly relative to said frame.

5. The sprinkler head of claim 2, wherein each spring clip comprises a flexible arm biased into engagement with the respective abutment.

6. The sprinkler head of claim 1, and including guide means for guiding said ring in upward movement on said frame.

7. The sprinkler head of claim 6, wherein said guide means comprises a pair of longitudinal guide channels disposed in spaced relation on said ring and located to engage side edges of the arms of said frame.

8. The sprinkler head of claim 1, wherein said thermally responsive means comprises a glass bulb.

9. The sprinkler head of claim 1, and including a deflector disposed beneath said frame, and guide means for mounting the deflector for movement between an upper position and a lower extended position.

10. The sprinkler head of claim 9, wherein said guide means comprises a pair of bosses each connected to one of the arms of said frame, and a pair of rods connected to said deflector and slidable within the respective bosses.

11. The sprinkler head of claim 10, wherein said bosses project outwardly from the respective arms in opposite directions.

12. The sprinkler head of claim 1, wherein the upper end of the sleeve is provided with an inwardly extending flange, said biasing means comprising a compression spring disposed between said flange and said ring.

13. The sprinkler head of claim 1, wherein said interconnecting means interconnecting the sleeve and the ring comprises an abutment on said ring and engaged with a first surface on said sleeve, said sleeve having an elongated recess offset circumferencially and extending downwardly from said first surface, relative rotation between said sleeve and said ring effecting movement of said abutment from said first surface to said recess.

14. An improved concealed sprinkler head comprising a frame having an outlet to be connected to a water line, said frame including a pair of arms connected together at lower ends thereof at a junction, valve cap means to enclose said outlet, thermally responsive means interconnecting the valve cap means and said junction for releasing said valve cap means when said thermally responsive means is exposed to a predetermined elevated temperature, and a preassembled cover plate unit connected to the frame and including a generally tubular sleeve exposed outwardly of said frame, said sleeve having a recess and having an elongated slot offset circumferentially from said recess, a ring disposed within the sleeve and located outwardly of the frame, a spring interposed between an upper end of said sleeve and said ring, a tab on said ring and engaged with a bottom of said recess to maintain the spring in a compressed condition, a cover plate, fusible means interconnecting a lower end of the sleeve and the cover plate, guide means on said ring for guiding the ring in upward movement on said frame, a pair of spring clips connected to opposed portions of said ring, and notch means on the lower end of each arm and disposed to be engaged by the respective spring clips as said unit is moved upwardly relative to said frame to thereby lock said unit relative to said frame, rotation of said sleeve and cover plate relative to said ring moving said tab from said recess to said elongated slot to thereby release said spring from the compressed condition to urge said sleeve and cover plate upwardly relative to said ring to bring said cover plate into engagement with a lower surface of a ceiling of a building.

15. The sprinkler head of claim 14, wherein said guide means comprises a pair of longitudinal guide channels disposed in spaced relation on said ring and located to engage side edges of said arms as said unit is moved upwardly on said frame.

16. The sprinkler head of claim 15, wherein said notch means is disposed in each side edge.

* * * * *